US009828830B2

(12) United States Patent
McCabe

(10) Patent No.: US 9,828,830 B2
(45) Date of Patent: Nov. 28, 2017

(54) DUAL-FLOW VALVE ASSEMBLY

(71) Applicant: Schlumberger Technology Corporation, Sugar Land, TX (US)

(72) Inventor: Jeffrey Conner McCabe, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 507 days.

(21) Appl. No.: 14/019,593

(22) Filed: Sep. 6, 2013

(65) Prior Publication Data

US 2015/0068773 A1 Mar. 12, 2015

(51) Int. Cl.

| | |
|---|---|
| ***E21B 34/10*** | (2006.01) |
| ***E21B 34/06*** | (2006.01) |
| ***E21B 17/18*** | (2006.01) |

(52) U.S. Cl.

CPC ..... *E21B 34/06* (2013.01); *E21B 17/18* (2013.01)

(58) Field of Classification Search

CPC ..... E21B 34/08; E21B 34/10; E21B 33/12; E21B 43/12; E21B 34/06; E21B 17/18

USPC ..... 166/387

See application file for complete search history.

(56) References Cited

U.S. PATENT DOCUMENTS

| | | | | |
|---|---|---|---|---|
| 3,064,735 | A * | 11/1962 | Bauer | E21B 23/002 166/339 |
| 3,451,481 | A * | 6/1969 | Lanmon | E21B 33/047 166/313 |
| 2004/0104052 | A1 | 6/2004 | Livingstone | |
| 2010/0252276 | A1 | 10/2010 | Clausen et al. | |
| 2011/0005766 | A1 | 1/2011 | Shand | |
| 2011/0226483 | A1* | 9/2011 | Donald | E21B 33/03 166/344 |
| 2013/0098632 | A1 | 4/2013 | Wetzel et al. | |
| 2013/0126769 | A1 | 5/2013 | Weir et al. | |

OTHER PUBLICATIONS

International Search Report and the Written Opinion for International Application No. PCT/US2014/053914 dated Dec. 26, 2014.

* cited by examiner

*Primary Examiner* — Taras P Bemko

(74) *Attorney, Agent, or Firm* — Michael L. Flynn; Robin Nava

(57) ABSTRACT

A valve assembly connectable between first and second downhole components that each have first and second internal flowpaths. The valve assembly comprises a first valve operable to selectively fluidly couple the first internal flowpaths of the first and second downhole components, as well as a second valve operable to selectively fluidly couple the second internal flowpaths of the first and second downhole components.

18 Claims, 5 Drawing Sheets

DUAL-FLOW VALVE ASSEMBLY

BACKGROUND OF THE DISCLOSURE

Tool strings conveyed in wellbores in the course of constructing and maintaining oil and gas wells may range in length up to several hundred meters. Deploying a longer tool string into a pressurized wellbore may utilize one or more deployment bars between shorter, more manageable sections of the tool string. However, this technique is not available when there are two flowpaths, such as a first flowpath for pressurized fluid being pumped through the tool string and a second flowpath for fluid flowing out of the wellbore to surface equipment. That is, the two flowpaths cannot be adequately isolated from one another as the tool string is incrementally assembled and deployed into the wellbore.

SUMMARY OF THE DISCLOSURE

The present disclosure introduces an apparatus comprising: a valve assembly connectable between first and second downhole components that each have first and second internal flowpaths, wherein the valve assembly comprises: a first valve operable to selectively fluidly couple the first internal flowpaths of the first and second downhole components; and a second valve operable to selectively fluidly couple the second internal flowpaths of the first and second downhole components. The valve assembly may be connectable directly between the first and second downhole components. The first downhole component may comprise a portion of a bottom-hole assembly, and the second downhole component may comprise a deployment bar. The first and second downhole components may comprise respective first and second portions of a bottom-hole assembly. The first downhole component may comprise a coiled tubing connector.

The present disclosure also introduces a method comprising: assembling a first bottom-hole assembly (BHA) portion, a dual-flow valve assembly, and a deployment bar within a lubricator; attaching the lubricator to a wellhead comprising a closed blow-out preventer (BOP); opening the BOP, then lowering the first BHA portion through the BOP into a wellbore extending from the wellhead, and then closing the BOP around the deployment bar; assembling a second BHA portion to the dual-flow valve assembly within the lubricator, including establishing fluid communication between the closed first and second valves and respective first and second flowpaths of the second BHA portion; fluidly coupling coiled tubing to the second BHA portion and then opening the first and second valves; and opening the BOP and extending the coiled tubing into the wellbore, thus conveying the first and second BHA portions within the wellbore; wherein assembling the first BHA portion, the dual-flow valve assembly, and the flow deployment bar within the lubricator establishes fluid communication between: a closed first valve of the dual-flow valve assembly and a first internal flowpath of the first BHA portion; and a closed second valve of the dual-flow valve assembly and a second internal flowpath of the first BHA portion. The method may further comprise detaching the lubricator from the wellhead after closing the BOP around the deployment bar and before assembling the second BHA portion to the dual-flow valve assembly within the lubricator.

The present disclosure also introduces a method comprising: closing a blow-out preventer (BOP) around a deployment bar extending between a bottom-hole assembly (BHA) portion that is below the BOP and a dual-flow valve assembly that is above the BOP; and completing the BHA by iteratively: assembling a subsequent BHA portion to the dual-flow valve assembly that is assembled to the deployment bar around which the BOP is closed, wherein the subsequent BHA portion is coupled with an additional dual-flow valve assembly via an additional deployment bar; opening first and second valves of the dual-flow valve assembly that is assembled to the deployment bar around which the BOP is closed; opening the BOP; lowering the assembled BHA portions in a wellbore extending from a wellhead comprising the BOP; and closing the BOP around the uppermost deployment bar.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
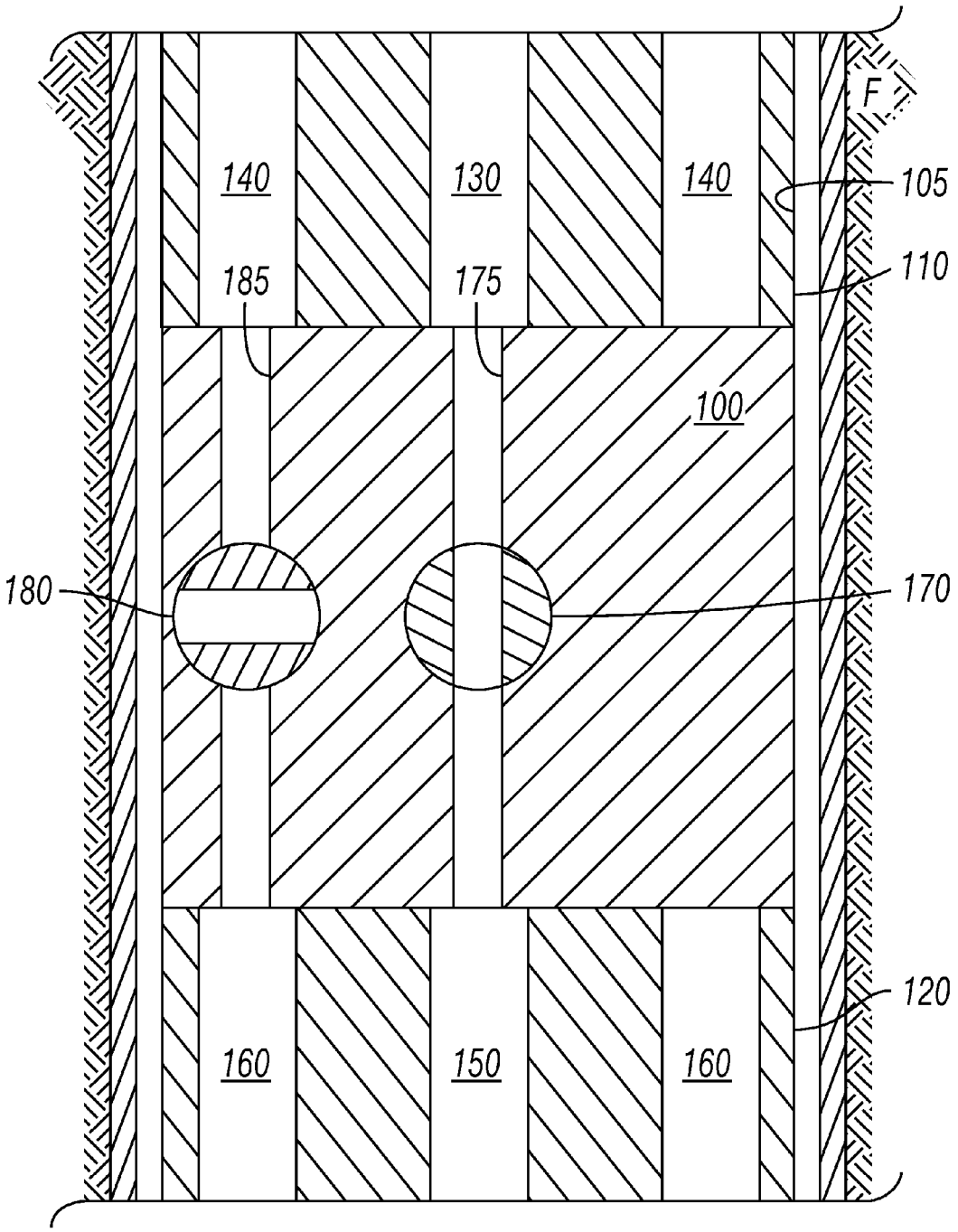
FIG. 1 is a sectional view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a sectional view of at least a portion of apparatus according to one or more aspects of the present disclosure. The apparatus comprises a dual-flow valve assembly 100 interconnecting a first downhole component 110 and a second downhole component 120 within a wellbore 105.

The first downhole component 110 includes a first internal flowpath 130 and a second internal flowpath 140, one or both of which may be those of (or in fluid communication with) a tool string in which the first downhole component 110 is included. The first and second internal flowpaths 130 and 140 may be substantially concentric. The second downhole component 120 similarly includes a first internal flowpath 150 and a second internal flowpath 160. The first and second internal flowpaths 150 and 160 may be substantially concentric. The perimeter of the wellbore 105 may be or comprise an inner diameter of casing, lining, and/or other tubing that may be cemented or otherwise installed in the wellbore. The perimeter may also be or comprise surfaces of one or more formations F created when the wellbore was formed.

The dual-flow valve assembly 100 comprises a first valve 170 fluidly coupling the first internal flowpaths 130 and 150 of the first and second downhole components 110 and 120, respectively. For example, the dual-flow valve assembly 100 may comprise a flowpath 175 comprising the first valve 170 and extending between the first internal flowpaths 130 and 150 of the first and second downhole components 110 and 120. The dual-flow valve assembly 100 also comprises a second valve 180 coupling the second internal flowpaths 140 and 160 of the first and second downhole components 110 and 120, respectively. For example, the dual-flow valve assembly 100 may comprise a flowpath 185 comprising the second valve 180 and extending between the second internal flowpaths 140 and 160 of the first and second downhole components 110 and 120. The flowpaths 175 and 185 of the valve assembly 100 may be substantially non-concentric, including in implementations in which two or more of the first and second internal flowpaths 130, 140, 150, and 160 are substantially concentric within corresponding ones of the first and second downhole components 110 and 120, as shown in the example depicted in FIG. 1.

The first and second valves 170 and 180 may be externally accessible, such that a human or other operator may open and/or close the valves before the assembly 100 is deployed in the wellbore 105. The valves 170 and 180 are depicted in FIG. 1 as ball valves, but many other types of valves may also be employed, including globe valves, butterfly valves, gate valves, and/or other types of two-position or two-port valves.

The dual-flow valve assembly 100 may be directly coupled to the first and second downhole components 110 and 120, such as by box-pin couplings, other threaded couplings, and/or other fastening means. The dual-flow valve assembly 100 may also be indirectly coupled to one or both of the first and second downhole components 110 and 120, such as via one or more intervening components.

One of the first and second downhole components 110 and 120 may be or comprise a module, section, component, and/or other portion of a bottom-hole assembly (BHA) and/or other portion of a tool string. One of the first and second downhole components 110 and 120 may also be or comprise a deployment bar. A deployment bar may be or comprise a length of tubing long enough to extend through and span a total height of a blow-out preventer (BOP) and/or other wellhead equipment, and may terminate at both ends with one side of a box-pin coupling, although other threaded couplings and/or other interfaces may also be utilized for assembling the deployment bar within a BHA or other tool string. A substantial portion of the length of the deployment bar may have a smaller diameter relative to the assembly 100 and/or the downhole component 110/120 opposite the assembly 100 from the deployment bar. The deployment bar may comprise first and second passageways extending or otherwise in fluid communication with the first and second internal flowpaths of one of the first and second downhole components 110 and 120. One of the first and second downhole components 110 and 120 may also be or comprise coiled tubing and/or a coiled tubing interface.

Figure 2:
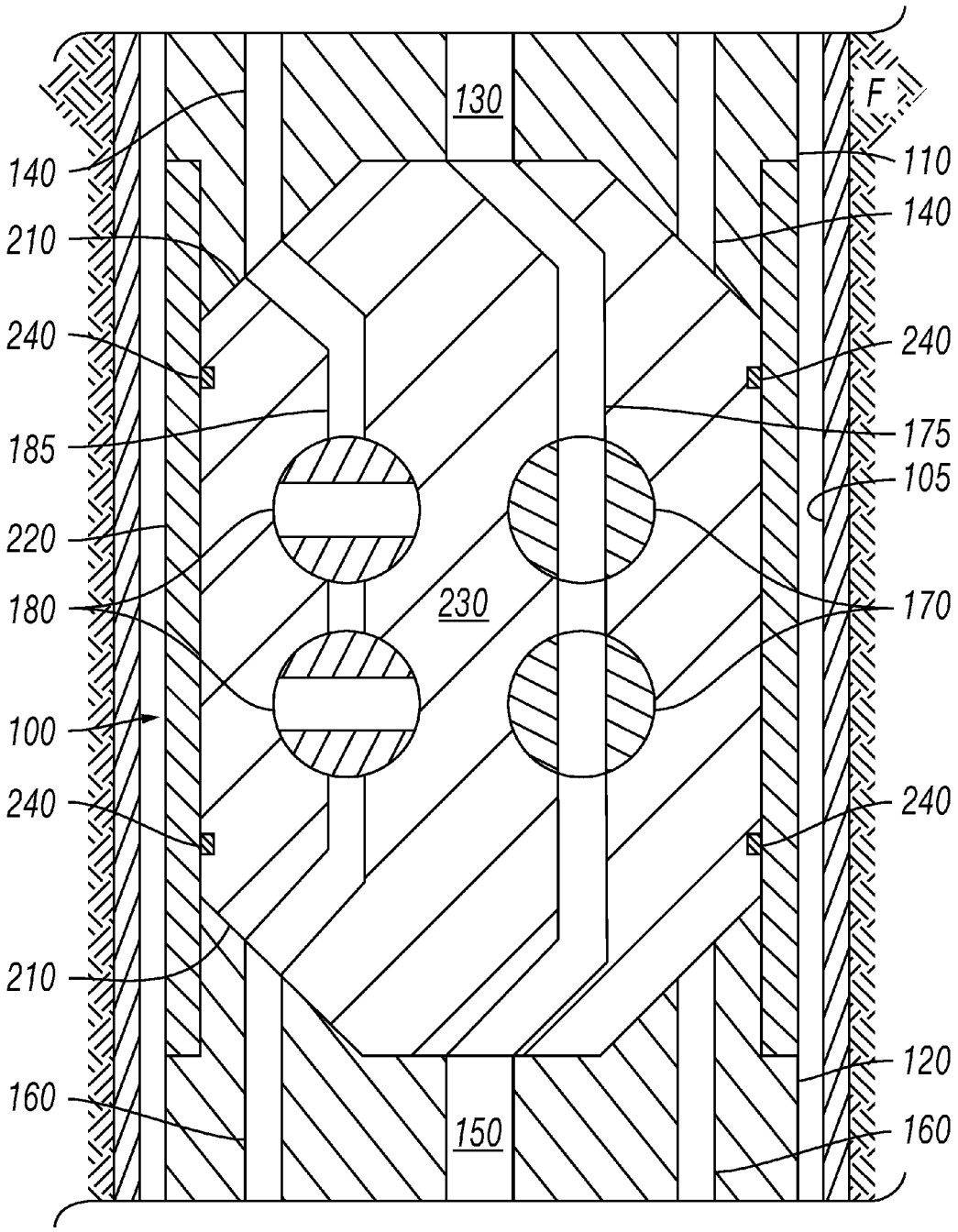
FIG. 2 is a sectional view of at least a portion of apparatus according to one or more aspects of the present disclosure.

FIG. 2 is a sectional view depicting additional and/or optional details of the apparatus shown in FIG. 1. For example, the end surfaces 210 of the dual-flow valve assembly 100 that are connected by the flowpath 185 may not be substantially parallel to the longitudinal axis of the wellbore 105, but may instead be conical, as depicted in FIG. 2, as well as spherical, pyramidal, and/or otherwise shaped.

As also depicted in FIG. 2, the first valve 170 selectively fluidly coupling the internal flowpaths 130 and 150 of the first and second downhole components 110 and 120, respectively, may be or comprise a plurality of first valves 170, each of which may be substantially similar, and which may be collectively coupled in series along the flowpath 175. The second valve 180 may similarly be or comprise a plurality of second valves 180, each of which may be substantially similar, and which may be collectively coupled in series along the flowpath 185. One or more of the plurality of first valves 170 and/or the plurality of second valves 180 may be externally accessible for human and/or other operation before the dual-flow valve assembly 100 is deployed in the wellbore 105. Utilizing a plurality of valves in this manner may provide redundancy (in the embodiment of at least a pair of valves in each of the flowpaths 175 and 185) and/or otherwise aid in ensuring fluidic isolation across the dual-flow valve assembly 100 when closing either or both of the flowpaths 175 and 185.

Another optional feature depicted in FIG. 2 is an external housing 220 containing all or a portion of a body portion 230 of the dual-flow valve assembly 100. An outer diameter $D_H$ of the external housing 220 may be substantially similar to an outer diameter $D_1$ of the first downhole component 110 and/or an outer diameter $D_2$ of the second downhole component 120, although other configurations are also within the scope of the present disclosure. The external housing 220 and/or other portion of the dual-flow valve assembly 100 may be directly coupled to the first and second downhole components 110 and 120, such as by box-pin couplings, other threaded couplings, and/or other fastening means. The external housing 220 and/or other portion of the dual-flow valve assembly 100 may also be indirectly coupled to one or both of the first and second downhole components 110 and 120, such as via one or more intervening components.

The dual-flow valve assembly 100 may also comprise one or more external sealing members 240. For example, one or more O-rings, wipers, and/or other sealing members 240 may aid and/or ensure fluidic isolation of fluids on opposing sides of the dual-flow valve assembly 100 when the valves 170 and 180 are closed.

Figure 3:
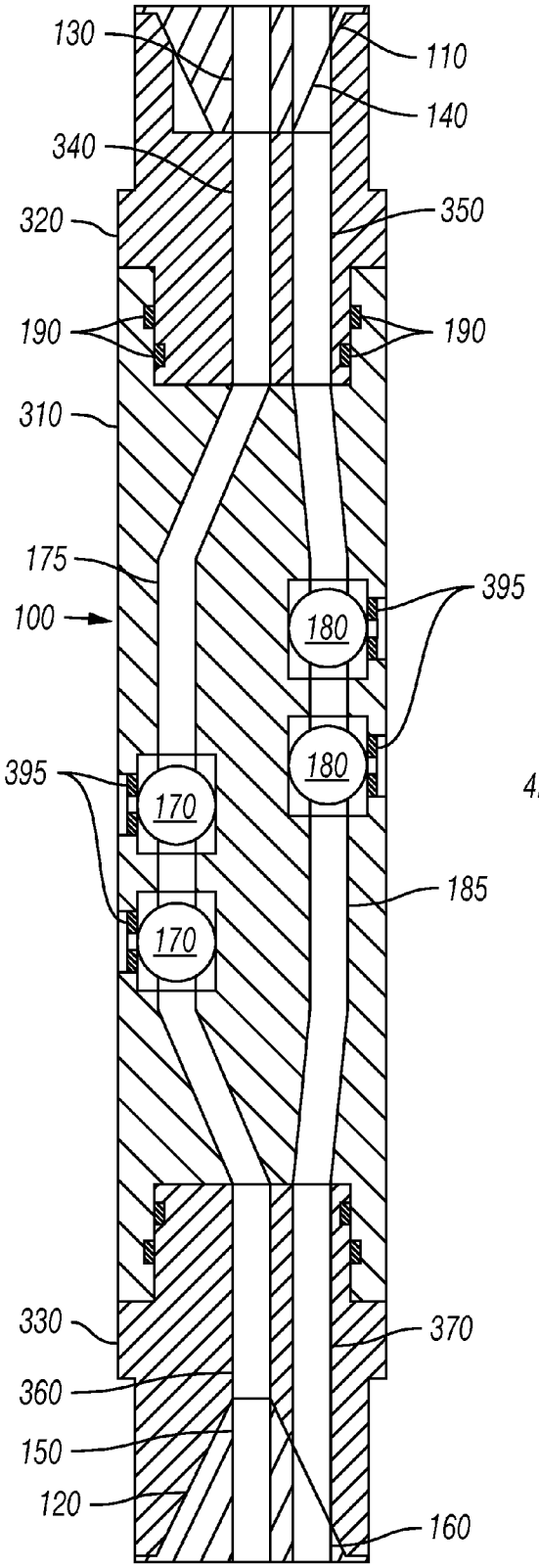
FIG. 3 is a sectional view of at least a portion of apparatus according to one or more aspects of the present disclosure.

FIG. 3 is a sectional view depicting additional and/or optional details of the apparatus shown in FIGS. 1 and 2. For example, the dual-flow valve assembly 100 may comprise a cartridge 310 comprising the first and second valves 170 and 180, a first interface 320 mechanically and fluidly coupling the cartridge 310 with the first downhole component 110, and a second interface 330 mechanically and fluidly coupling the cartridge 310 and the second downhole component 120. The flowpath 175 extending between the first internal flowpaths 130 and 150 of the first and second downhole components 110 and 120 and comprising the one or more first valves 170 may also extend through the cartridge 310 and the first and second interfaces 320 and 330. Similarly, the flowpath 185 extending between the second internal flowpaths 140 and 160 of the first and second downhole components 110 and 120 and comprising the one or more second valves 180 may also extend through the cartridge 310 and the first and second interfaces 330 and 330. The flowpaths 175 and 185 may not be substantially concentric within the cartridge 310 and/or the first and/or second interfaces 320 and 330.

The cartridge 310 may be coupled between the first and second interfaces 320 and 330 via box-pin couplings, other threaded couplings, and/or other fastening means. One or more sealing members 190 may provide fluid isolation between the cartridge 310 and the first and second interfaces 330 and 330, and/or from the wellbore 105. The bulk of the cartridge 310 and/or the first and second interfaces 320 and 330 may substantially comprise metallic materials commonly employed for downhole applications. The one or more first valves 170 may be azimuthally offset from the one or more second valves 180 by about 180 degrees, as depicted in FIG. 3, although other angular offsets are also within the scope of the present disclosure. The one or more first valves 170 may be azimuthally offset from one another, as may the one or more second valves 180.

The first and second interfaces 320 and 330 may comprise passages fluidly coupling the flowpaths 175 and 185 of the cartridge 310 to the internal flowpaths associated with the first and second downhole components 110 and 120. For example, the first interface 320 may comprise a passage 340 that, when the interface 320 is coupled to the first downhole component 110, fluidly couples the first internal flowpath 130 of the first downhole component 110 with the flowpath 175 of the cartridge 310. Similarly, a passage 350 of the first interface 320 may fluidly couple the second internal flowpath 140 of the first downhole component 110 to the flowpath 185 of the cartridge 310. The second interface 330 may comprise a passage 360 that, when the interface 330 is coupled to the second downhole component 120, fluidly couples the first internal flowpath 150 of the second downhole component 120 with the flowpath 175 of the cartridge 310. Similarly, a passage 370 of the second interface 330 may fluidly couple the second internal flowpath 160 of the second downhole component 120 to the flowpath 185 of the cartridge 310.

The first and second interfaces 320 and 330 may comprise means for coupling the dual-flow valve assembly 100 to the first and second downhole components 110 and 120. Such coupling means may comprise box-pin couplings, other threaded couplings, and/or other fastening means.

Figure 4:
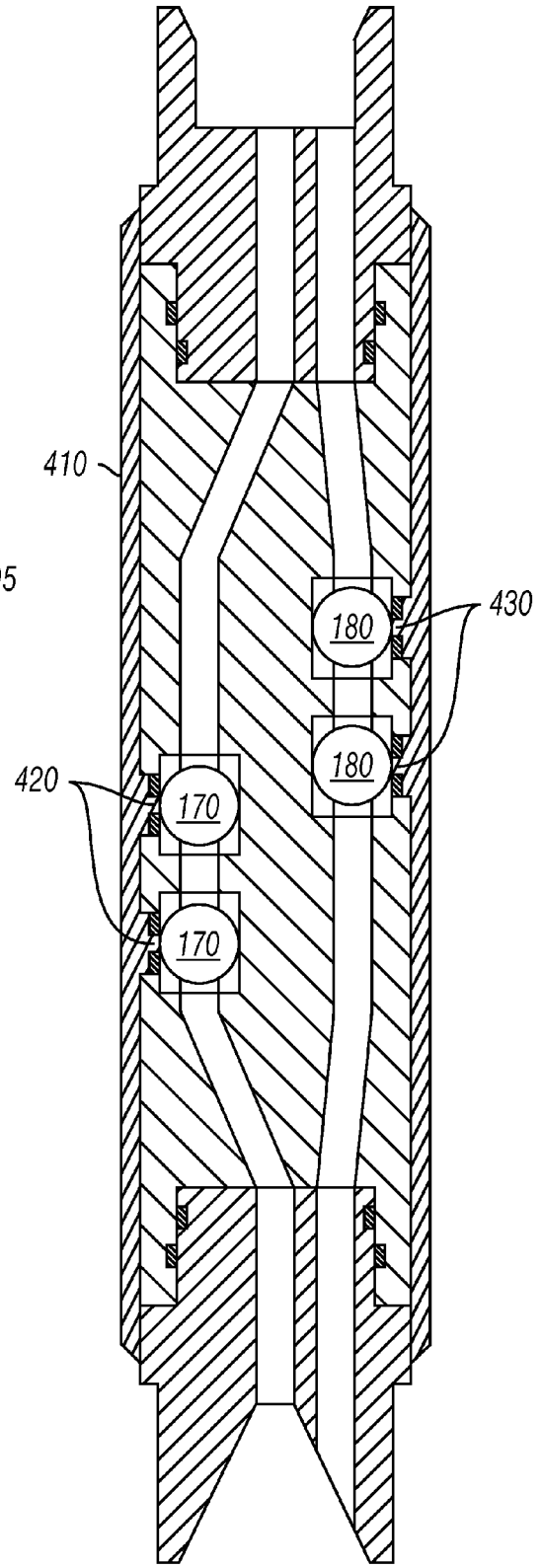
FIG. 4 is a sectional view of at least a portion of apparatus according to one or more aspects of the present disclosure.

Each of the first and second valves 170 and 180 may comprise access points 395 which are externally accessible for human or other operation. The access points 395 may be or comprise standard tool interfaces, such as for a ratchet drive, a hex wrench, a screwdriver, and/or other tools. FIG. 4 is a schematic view of the dual-flow valve assembly 100 as shown in FIG. 3 with the addition of a detachable guard 410 covering the access points 395. The detachable guard 410 may be or comprise a unitary or multi-portion sleeve encircling an outer perimeter of the dual-flow valve assembly 100. The detachable guard 410 may comprise one or more elastomeric and/or metallic materials, such as may aid in preventing damage to the dual-flow valve assembly 100. The detachable guard 410 may further aid in preventing inadvertent access to and/or operation of the first and second valves 170 and 180. For example, the detachable guard may comprise first inserts 420 configured to engage with and prevent access to the access points 395 of corresponding ones of the first valves 170, and/or second inserts 430 configured to engage with and prevent access to the access points 395 of corresponding ones of the second valves 180. The inserts 420 and 430 may be protrusions integral to the detachable guard 410, extending radially inward from an inner diameter of the detachable guard 410 into the access points 395. The inserts 420 and 430 may also be discrete components separate from the detachable guard 410, which may be permanently or detachably coupled to the detachable guard 410 or the access points 395.

Figure 5:
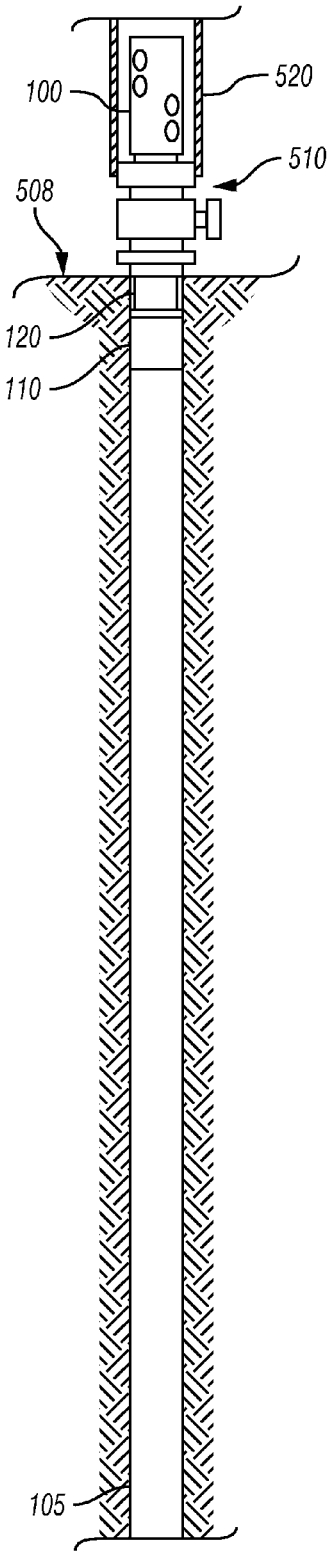
FIG. 5 is a schematic view of at least a portion of apparatus according to one or more aspects of the present disclosure.
Figure 6:
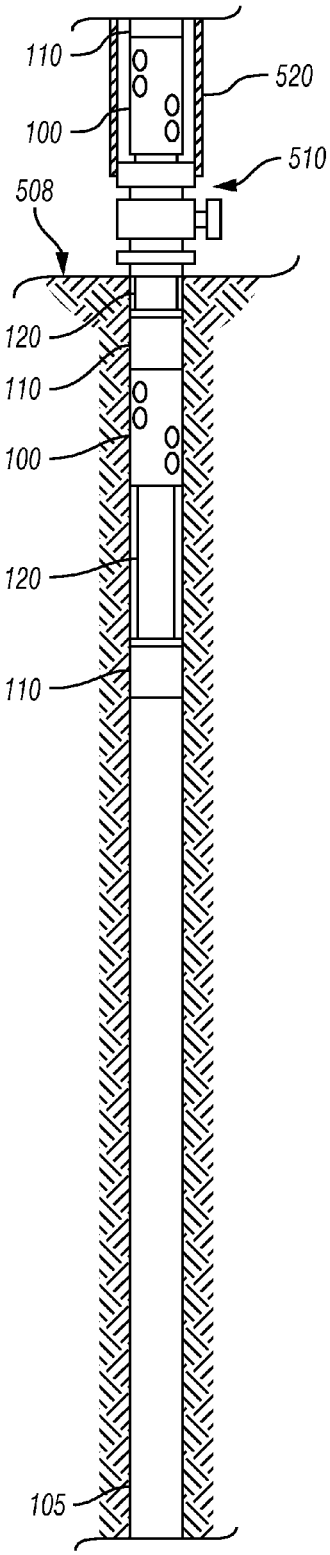
FIG. 6 is a schematic view of at least a portion of apparatus according to one or more aspects of the present disclosure.
Figure 7:
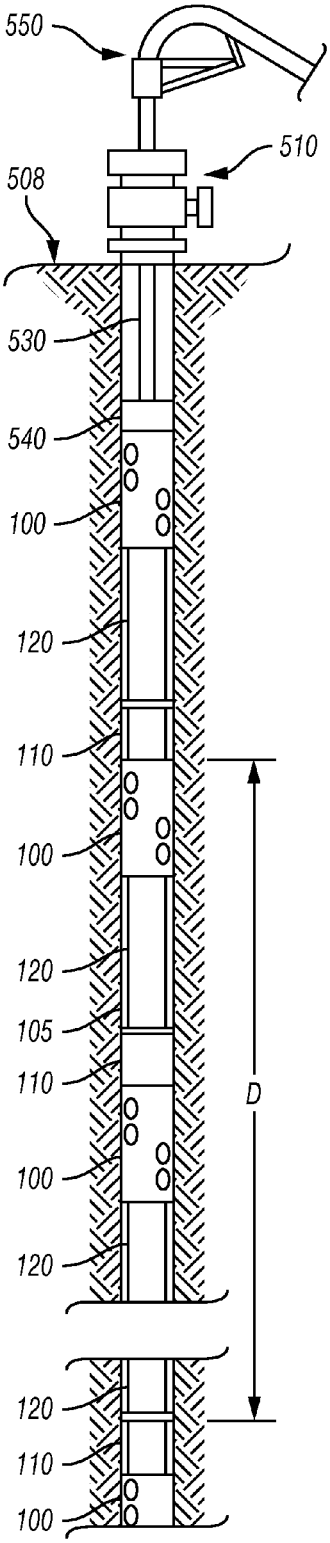
FIG. 7 is a schematic view of at least a portion of apparatus according to one or more aspects of the present disclosure.

FIGS. 5-7 are schematic views of multiple instances of the dual-flow valve assembly 100 shown in FIGS. 1-4 being utilized during the assembly and deployment of multiple instances of the first and second downhole components 110 and 120 in the wellbore 105 according to one or more aspects of the present disclosure. FIGS. 5-7 depict an example implementation in which multiple instances of the first downhole component 110 comprise portions of a BHA, and multiple instances of the second downhole component 120 comprise deployment bars as described above. In other implementations within the scope of the present disclosure, the first and second downhole components 110 and 120 may comprise other downhole components.

In the deployment stage shown in FIG. 5, a deployment bar 120 is coupled between a dual-flow valve assembly 100 and a BHA portion 110. The valves of the dual-flow valve assembly 100 are closed. A BOP 510 at an oilfield surface 508 is closed around the deployment bar 120, such that the dual-flow valve assembly 100 is positioned above the BOP 510. A lubricator 520 may be utilized as a pressure chamber for deploying the BHA portion 110 into the pressurized wellbore 105. For example, the BHA portion 110, the deployment bar 120, and the dual-flow valve assembly 100 may be assembled within the lubricator 520, and the lubricator 520 may be attached to the BOP 510. The BHA portion 110 may then be lowered into the wellbore 105, and the BOP 510 may then be closed around the deployment bar 120. The lubricator 520 may then be removed from the BOP 510.

In a subsequent stage of deployment shown in FIG. 6, a similar procedure lengthens the tool string portion that is deployed in the wellbore 105. That is, the dual-flow valve assembly 100, the deployment bar 120, and the BHA portion 110 shown in FIG. 5 have been positioned lower in the wellbore 105, having been coupled to an additional BHA portion 110, an additional deployment bar 120, and an additional dual-flow valve assembly 100. The BOP 510 is closed around the additional, uppermost deployment bar 120, such that the additional, uppermost dual-flow valve assembly 100 is positioned above the BOP 510. The dual-flow valve assembly 100 or assemblies 100 advantageously allows for deployment of longer lengths of BHA portions 110 and assemblies 100 while utilizing conventional surface resources such as, but not limited to, the BOP 510 and the lubricator 520.

This procedure may be iterated a number of times until substantially the entire length of the tool string is fully assembled and deployed within the wellbore 105, as shown in FIG. 7. The uphole end of the tool string may be connected to coiled tubing 530 by a coiled tubing connector 540, although additional BHA components may be coupled between the uppermost dual-flow valve assembly 100 and the coiled tubing connector 540. A coiled tubing injector 550 may also be assembled above the BOP 510 to guide the coiled tubing 530 in and out of the wellbore 105.

Two (or more) of the BHA portions 110 assembled in the tool string may be or comprise packer modules separated by a mutual offset distance D. The distance D may vary within the scope of the present disclosure. For example, the distance D may be at least about 50 feet (about 15 meters), or at least about 75 feet (about 23 meters), among other example offset distances. The packer modules may be inflated and/or otherwise operated to isolate a portion of the wellbore 105 between the packer modules from the rest of the wellbore 105.

Figure 8:
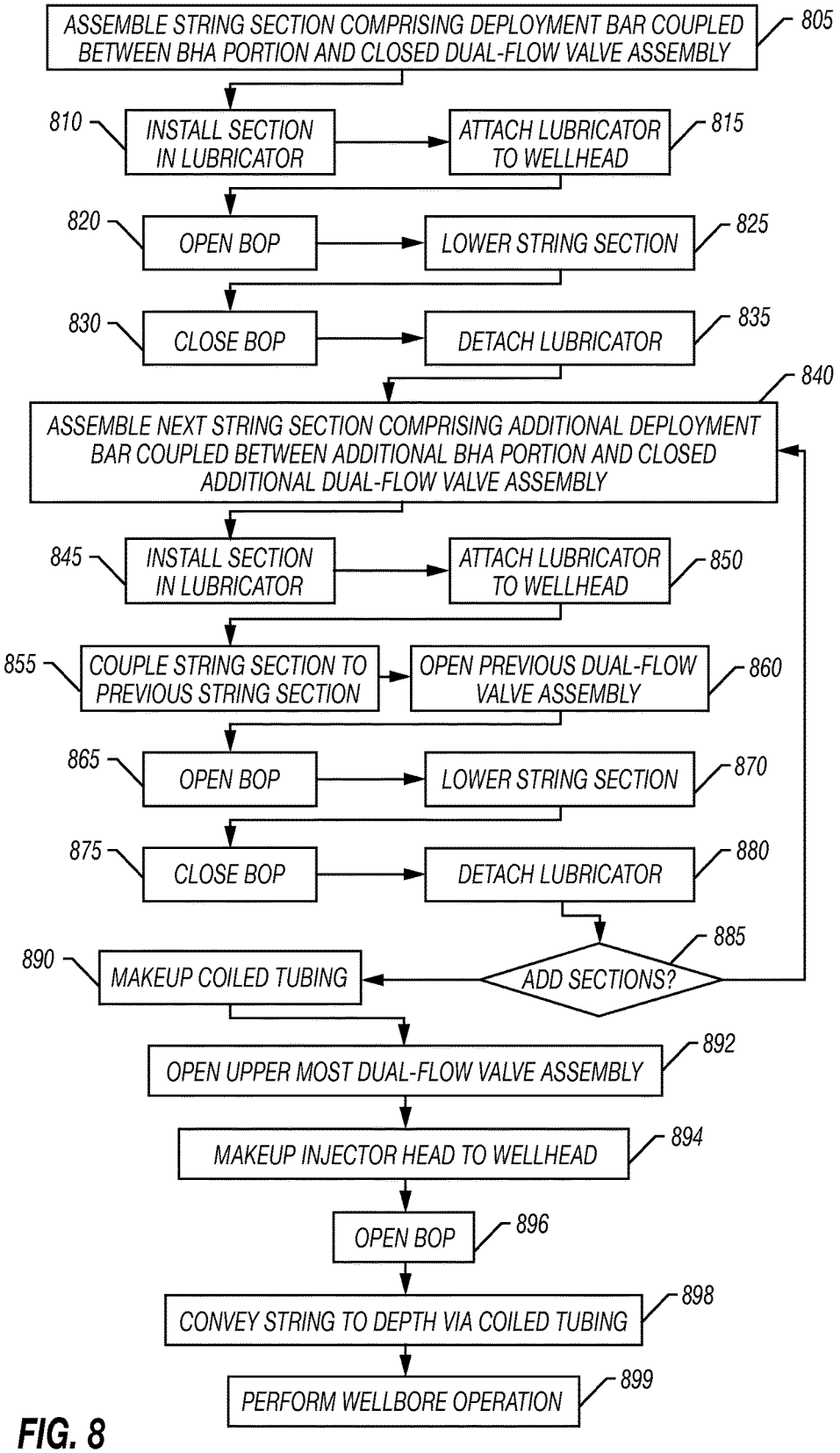
FIG. 8 is a flow-chart diagram of at least a portion of a method according to one or more aspects of the present disclosure.

FIG. 8 is a flow-chart diagram of at least a portion of a method (800) according to one or more aspects of the present disclosure. With continued reference to FIGS. 1-7, the method (800) shown at least partially in FIG. 8 comprises assembling (805) a first tool string section comprising a deployment bar 120 coupled between a BHA portion 110 and a closed dual-flow valve assembly 100. This section may then be installed (810) in a lubricator 520, and the lubricator 520 may then be attached (815) to the wellhead/BOP 510.

The BOP 510 may then be opened (820), and the string section assembled in the lubricator 520 may be lowered (825) until the deployment bar 120 spans the length of the BOP 510. The BOP 510 may then be closed (830) around the deployment bar 120, and the lubricator 520 may then be detached (835) from the wellhead/BOP 510.

The next string section comprising an additional deployment bar 120 coupled between an additional BHA portion 110 and an additional closed dual-flow valve assembly 100 may then be assembled (840) and installed (845) in a lubricator 520. The lubricator 520 may then be attached (850) to the wellhead/BOP 510, and the new string section may be coupled (855) to the previous string section. The valves of the existing dual-flow valve assembly 100, positioned immediately above the BOP 510, may then be opened (860).

The BOP 510 may then be opened (865), and the new string section assembled in the lubricator 520 may be lowered (870) until the new deployment bar 120 spans the length of the BOP 510. The BOP 510 may then be closed (875) around the new deployment bar 120, and the lubricator 520 may then be detached (880) from the wellhead/BOP 510.

If the determination is made (885) that additional string sections have yet to be assembled and deployed in the wellbore 110, then this process is iterated for each new string section. If no additional string sections remain, then the coiled tubing connector 540 may be utilized to make up (890) the coiled tubing to the uppermost dual-flow valve assembly 100, the valves of which may then be opened (892). The injector head 550 may then be made up (894) to the wellhead/BOP 510, and the BOP 510 may be opened (896). The assembled, deployed tool string may then be conveyed (898) to a predetermined depth within the wellbore 105 via the coiled tubing 530. After the tool string is conveyed to a predetermined depth, a wellbore operation (899) may be performed with the tool string. Non-limiting examples of such wellbore operations, such as those utilizing the straddle packer assemblies described above, may comprise an acid cleanout operation, a water shutoff operation, or other coiled tubing operations, as will be appreciated by those skilled in the art. After the wellbore operation is completed, the tool string may be retrieved back to the oilfield surface.

In view of all of the above and the figures, a person having ordinary skill in the art will readily recognize that the present disclosure introduces an apparatus comprising: a valve assembly connectable between first and second downhole components that each have first and second internal flowpaths, wherein the valve assembly comprises: a first valve operable to selectively fluidly couple the first internal flowpaths of the first and second downhole components; and a second valve operable to selectively fluidly couple the second internal flowpaths of the first and second downhole components. The valve assembly may be connectable directly between the first and second downhole components. The first downhole component may comprise a portion of a bottom-hole assembly, and the second downhole component may comprise a deployment bar. The first and second downhole components may comprise respective first and second portions of a bottom-hole assembly. The first downhole component may comprise a coiled tubing connector.

The first and second valves may be individually externally accessible for selective operation. The apparatus may further comprise a detachable guard covering externally accessible access points of the first and second valves. The guard may comprise a sleeve encircling an outer perimeter of the valve assembly. The detachable guard may comprise first and second inserts engaged with and preventing access to corresponding ones of the first and second access points. The first and second inserts may be radially-inward extending protrusions integral to the guard.

The valve assembly may further comprise: a third flowpath extending between the first internal flowpaths of the first and second downhole components, wherein the first valve is in the third flowpath; and a fourth flowpath extending between the second internal flowpaths of the first and second downhole components, wherein the second valve is in the fourth flowpath. The first and second internal flowpaths may be substantially concentric within each of the first and second downhole components, while the third and fourth flowpaths may not be substantially concentric within the valve assembly.

The valve assembly may further comprise: a cartridge comprising the first and second valves; a first interface mechanically and fluidly coupling the cartridge and the first downhole component; and a second interface mechanically and fluidly coupling the cartridge and the second downhole component. The valve assembly may further comprise: a third flowpath extending between the first internal flowpaths of the first and second downhole components, extending through the cartridge and the first and second interfaces, and comprising the first valve; and a fourth flowpath extending between the second internal flowpaths of the first and second downhole components, extending through the cartridge and the first and second interfaces, and comprising the second valve. The first and second internal flowpaths may be substantially concentric within each of the first and second downhole components, while the third and fourth flowpaths may not be substantially concentric within the cartridge.

The first valve may comprise a plurality of first valves collectively coupled in series between the first internal flowpaths of the first and second downhole components, and the second valve may comprise a plurality of second valves collectively coupled in series between the second internal flowpaths of the first and second downhole components. Each of the pluralities of first and second valves may be individually externally accessible for selective operation.

The valve assembly may further comprise one or more internal and/or external sealing members. The sealing member(s) may comprise an O-ring.

The apparatus may further comprise a deployment bar coupled with the valve assembly. The deployment bar may comprise: a first passageway extending the first internal flowpath of one of the first and second downhole components; and a second passageway extending the second internal flowpath of the one of the first and second downhole components. The apparatus may further comprise: a coiled tubing connector; and coiled tubing connected to the valve assembly via the coiled tubing connector. The apparatus may further comprise first and second packer modules, wherein the valve assembly and the deployment bar may be coupled between the first and second packer modules. The apparatus may further comprise first and second packer modules, wherein: the valve assembly may be one of a plurality of substantially similar valve assemblies; the deployment bar may be one of a plurality of substantially similar deployment bars; and the plurality of valve assemblies and the plurality of deployment bars may be interconnected with a plurality of bottom-hole assembly portions between the first and second packer modules. The first and second packer modules may be mutually offset by at least about 50 feet (about 15 meters) or by at least about 75 feet (about 23 meters).

The present disclosure also introduces a method comprising: assembling a first bottom-hole assembly (BHA) portion, a dual-flow valve assembly, and a deployment bar within a lubricator; attaching the lubricator to a wellhead comprising a closed blow-out preventer (BOP); opening the BOP, then lowering the first BHA portion through the BOP into a wellbore extending from the wellhead, and then closing the BOP around the deployment bar; assembling a second BHA portion to the dual-flow valve assembly within the lubricator, including establishing fluid communication between the closed first and second valves and respective first and second flowpaths of the second BHA portion; fluidly coupling coiled tubing to the second BHA portion and then opening the first and second valves; and opening the BOP and extending the coiled tubing into the wellbore, thus conveying the first and second BHA portions within the wellbore; wherein assembling the first BHA portion, the dual-flow valve assembly, and the flow deployment bar within the lubricator establishes fluid communication between: a closed first valve of the dual-flow valve assembly and a first internal flowpath of the first BHA portion; and a closed second valve of the dual-flow valve assembly and a second internal flowpath of the first BHA portion. The method may further comprise detaching the lubricator from the wellhead after closing the BOP around the deployment bar and before assembling the second BHA portion to the dual-flow valve assembly within the lubricator.

The method may further comprise, after closing the BOP around the deployment bar and before assembling the second BHA portion to the dual-flow valve assembly within the lubricator: assembling the second BHA portion within the lubricator; and reattaching the lubricator to the wellhead. The method may further comprise detaching the lubricator from the wellhead after assembling the second BHA portion to the dual-flow valve assembly within the lubricator and before fluidly coupling the coiled tubing to the second BHA portion.

The first BHA portion may comprise a first packer module, the second BHA portion may comprise a second packer modules, and the method may further comprise isolating a portion of the wellbore by operating the first and second packer modules after conveying the first and second BHA portions within the wellbore.

Opening the first and second valves may comprise externally accessing the first and second valves.

The method may further comprise installing a detachable guard covering externally accessible access points of the first and second valves before opening the BOP and extending the coiled tubing into the wellbore. Installing the detachable guard may comprise installing a sleeve encircling an outer perimeter of the valve assembly. The detachable guard may comprise first and second inserts, and installing the detachable guard may comprise engaging the first and second inserts with corresponding ones of the first and second access points.

The present disclosure also introduces a method comprising: closing a blow-out preventer (BOP) around a deployment bar extending between a bottom-hole assembly (BHA) portion that is below the BOP and a dual-flow valve assembly that is above the BOP; and completing the BHA by iteratively: assembling a subsequent BHA portion to the dual-flow valve assembly that is assembled to the deployment bar around which the BOP is closed, wherein the subsequent BHA portion is coupled with an additional dual-flow valve assembly via an additional deployment bar; opening first and second valves of the dual-flow valve assembly that is assembled to the deployment bar around which the BOP is closed; opening the BOP; lowering the assembled BHA portions in a wellbore extending from a wellhead comprising the BOP; and closing the BOP around the uppermost deployment bar.

The method may further comprise: coupling the completed BHA to a conveyance; and conveying the BHA within the wellbore by extending the conveyance into the wellbore. The conveyance may comprise coiled tubing.

The completed BHA may comprise first and second packer modules, and the method may further comprise isolating a portion of the wellbore by operating the first and second packer modules.

Opening the first and second valves may comprise externally accessing the first and second valves.

The method may further comprise installing a detachable guard covering externally accessible access points of the first and second valves of one of the dual-flow valve assemblies. Installing the detachable guard may comprise installing a sleeve encircling an outer perimeter of the one of the dual-flow valve assemblies. The detachable guard may comprise first and second inserts, and installing the detachable guard may comprise engaging the first and second inserts with corresponding ones of the first and second access points.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a first downhole component having a first and a second internal flowpath;

a second downhole component having a first and a second internal flowpath;

a valve assembly connectable between the first and the second downhole components, wherein the valve assembly comprises:

a first valve operable to selectively fluidly couple the first internal flowpaths of the first and second downhole components; and a second valve operable to selectively fluidly couple the second internal flowpaths of the first and second downhole components, wherein the first and second valves are individually externally accessible for selective operation; and a deployment bar coupled with the valve assembly, wherein the deployment bar comprises:

a first passageway extending the first internal flowpath of one of the first and second downhole components; and a second passageway extending the second internal flowpath of the one of the first and second downhole components.

2. The apparatus of claim 1 wherein the valve assembly is connectable directly between the first and second downhole components.

3. The apparatus of claim 1 wherein the first downhole component comprises a portion of a bottom-hole assembly, and wherein the second downhole component comprises a deployment bar.

4. The apparatus of claim 1 wherein the first and second downhole components comprise respective first and second portions of a bottom-hole assembly.

5. The apparatus of claim 1 wherein the valve assembly further comprises:

a third flowpath extending between the first internal flowpaths of the first and second downhole components, wherein the first valve is in the third flowpath; and a fourth flowpath extending between the second internal flowpaths of the first and second downhole components, wherein the second valve is in the fourth flowpath.

6. The apparatus of claim 1 wherein the valve assembly further comprises:

a cartridge comprising the first and second valves;

a first interface mechanically and fluidly coupling the cartridge and the first downhole component; and a second interface mechanically and fluidly coupling the cartridge and the second downhole component.

7. The apparatus of claim 6 wherein the valve assembly further comprises:

a third flowpath extending between the first internal flowpaths of the first and second downhole components, extending through the cartridge and the first and second interfaces, and comprising the first valve; and a fourth flowpath extending between the second internal flowpaths of the first and second downhole components, extending through the cartridge and the first and second interfaces, and comprising the second valve.

8. The apparatus of claim 1 wherein the first valve comprises a plurality of first valves collectively coupled in series between the first internal flowpaths of the first and second downhole components, and wherein the second valve comprises a plurality of second valves collectively coupled in series between the second internal flowpaths of the first and second downhole components.

9. The apparatus of claim 1 further comprising a detachable guard covering externally accessible access points of the first and second valves.

10. The apparatus of claim 1 further comprising first and second packer modules, wherein:

the valve assembly is one of a plurality of substantially similar valve assemblies;

the deployment bar is one of a plurality of substantially similar deployment bars; and the plurality of valve assemblies and the plurality of deployment bars are interconnected with a plurality of bottom-hole assembly portions between the first and second packer modules.

11. A method, comprising:

assembling a first bottom-hole assembly (BHA) portion, a dual-flow valve assembly, and a deployment bar within a lubricator, the dual-flow valve assembly comprising a first and a second valve;

attaching the lubricator to a wellhead comprising a closed blow-out preventer (BOP);

opening the BOP, then lowering the first BHA portion through the BOP into a wellbore extending from the wellhead, and then closing the BOP around the deployment bar;

assembling a second BHA portion to the dual-flow valve assembly within the lubricator, including establishing fluid communication between the closed first and second valves and respective first and second flowpaths of the second BHA portion;

fluidly coupling coiled tubing to the second BHA portion and then opening the first and second valves;

opening the BOP and extending the coiled tubing into the wellbore, thus conveying the first and second BHA portions within the wellbore;

lowering the BHA portions to a predetermined depth within the wellbore; and performing at least one wellbore operation, wherein assembling the first BHA portion, the dual-flow valve assembly, and the deployment bar within the lubricator establishes fluid communication between:

the closed first valve of the dual-flow valve assembly and a first internal flowpath of the first BHA portion; and the closed second valve of the dual-flow valve assembly and a second internal flowpath of the first BHA portion.

12. The method of claim 11 wherein the first BHA portion comprises a first packer module, wherein the second BHA portion comprises a second packer modules, and further comprising isolating a portion of the wellbore by operating the first and second packer modules after conveying the first and second BHA portions within the wellbore.

13. The method of claim 11 wherein opening the first and second valves comprises externally accessing the first and second valves.

14. The method of claim 11 further comprising installing a detachable guard covering externally accessible access points of the first and second valves before opening the BOP and extending the coiled tubing into the wellbore.

15. A method, comprising:

closing a blow-out preventer (BOP) around a deployment bar extending between a bottom-hole assembly (BHA) portion that is below the BOP and a dual-flow valve assembly that is above the BOP; and completing the BHA by iteratively:

assembling a subsequent BHA portion to the dual-flow valve assembly that is assembled to the deployment bar around which the BOP is closed, wherein the subsequent BHA portion is coupled with an additional dual-flow valve assembly via an additional deployment bar;

opening first and second valves of the dual-flow valve assembly that is assembled to the deployment bar around which the BOP is closed;

opening the BOP;

lowering the assembled BHA portions in a wellbore extending from a wellhead comprising the BOP;

closing the BOP around the uppermost deployment bar; and lowering the assembled BHA portions to a predetermined depth within the wellbore; and performing at least one wellbore operation.

16. The method of claim 15 wherein the completed BHA comprises first and second packer modules, and wherein the method further comprises isolating a portion of the wellbore by operating the first and second packer modules.

17. The method of claim 15 wherein opening the first and second valves comprises externally accessing the first and second valves.

18. The method of claim 15 further comprising installing a detachable guard covering externally accessible access points of the first and second valves of one of the dual-flow valve assemblies.

* * * * *